United States Patent [19]

Black

[11] Patent Number: 4,529,041

[45] Date of Patent: Jul. 16, 1985

[54] SOIL SCRAPER AND LEVELER

[76] Inventor: Milton W. Black, 1254 Adams Ave. P.O. Box 64, Gibbon, Minn. 55335

[21] Appl. No.: 575,079

[22] Filed: Jan. 30, 1984

[51] Int. Cl.[3] ..... E02F 3/76

[52] U.S. Cl. ..... 172/445.1; 172/316; 172/448

[58] Field of Search ..... 172/445.1, 445.2, 448, 172/474

[56] References Cited

U.S. PATENT DOCUMENTS

| | | | |
|---|---|---|---|
| 2,370,830 | 3/1945 | Arps | 172/254 |
| 2,463,169 | 3/1949 | Grewe | 172/474 |
| 2,512,114 | 6/1950 | Robinson | 172/445.2 |
| 3,234,669 | 2/1966 | Kachnik | 172/448 |
| 4,044,843 | 8/1977 | Holub | 172/684.5 |

FOREIGN PATENT DOCUMENTS

| | | | |
|---|---|---|---|
| 164277 | 7/1955 | Australia | 172/445.1 |
| 211279 | 11/1957 | Australia | 172/684.5 |

*Primary Examiner*—Richard J. Johnson

*Attorney, Agent, or Firm*—Zarley, McKee, Thomte, Voorhees & Sease

[57] ABSTRACT

The soil scraper of the present invention is adapted for use with a tractor or vehicle having a three point hitch. The device includes an elongated frame having a three point hitch receptacle mounted on its forward end and having an elongated scraper blade pivotally mounted to its rearward end. The scraper blade pivots about a horizontal axis and power means are provided for controlling the pivotal movement of the scraper blade about this horizontal axis. The frame has a length of at least five feet between the scraper blade and the three point hitch receptacle. The device can be used for scraping out the bottom of drainage ditches or other areas where it is desired to achieve the scraping action without placing the vehicle in the vicinity of the area being scraped.

3 Claims, 5 Drawing Figures

SOIL SCRAPER AND LEVELER

BACKGROUND OF THE INVENTION

This invention relates to a soil scraping device, and particularly a soil scraping device which can be mounted to the rear of a tractor, and which will scrape the ground at a point spaced a substantial distance from the wheels of the tractor.

Often drainage ditches in rural areas become filled with silt and require cleaning out. Conventional implements for farm tractors are ineffective for this purpose unless the tractor is driven into the ditch so that the implement can engage the bottom of the ditch. This often is impossible to do, however, since the ditch is often wet and muddy and the tractor can become bogged down when it is driven into the wet soil.

Presently known scraper blades for mounting on the three point hitch of tractors, are located in close vicinity to the tractor so that they cannot reach the bottom of the ditch unless the tractor is driven into the ditch.

Under present conditions, farm tractors are generally ineffective for scraping out the bottom of a ditch. It is therefore necessary for the farmer to hire a bulldozer or a backhoe device to come in and clean out drainage ditches. Both of these procedures are very expensive, and therefore farmers often do not properly tend to the drainage ditches around their farms.

Therefore, a primary object of the present invention is the provision of an improved scraping device and method for using same.

A further object of the present invention is the provision of an improved scraping device which may be mounted to the three point hitch of a tractor and which will engage the bottom of the ditch while the tractor is positioned outside the ditch.

A further objective of the present invention is the provision of a scraping device which permits the scraper blade to be moved in a scooping action, so that it can scoop out the loose silt at the bottom of the drainage ditch.

A further object of the present invention is the provision of a scraping device which permits the scraper blade to smooth out the silt which is scraped from the bottom of the drainage ditch.

A further object of the present invention is the provision of a scraping device which applies a pushing action to the blade at the time the blade is engaging the mud and silt at the bottom of a drainage ditch.

A further object of the present invention is the provision of a scraping device which has a frame located sufficiently far above the scraping blade to prevent the frame from hanging up on the ditch bank, disturbing the ditch bank, and hanging up on the trash and limbs which might be within the ditch whenever the blade is lowered to the bottom of the ditch.

A further object of the present invention is the provision of a device which is simple in construction, economical to manufacture, and durable in use.

SUMMARY OF THE INVENTION

The present invention utilizes an elongated frame having a three point hitch receptacle at the forward end, and having a scraper blade mounted at the rearward end. The frame is at least five feet long, and can be as long as ten or more feet. The length of the frame depends upon the weight and size of the tractor and the width of the ditch to be cleaned. As the length of the frame is increased a larger tractor is required to counterbalance the leverage applied by the blade and frame. This is also true for a larger or longer blade. Counterweights can also be applied to the tractor front end to counterbalance the leverage from the blade and frame.

The scraper blade mounted at the rear of the frame is pivoted about a horizontal axis so that its lower edge can be moved forwardly and rearwardly in response to pivotal movement about this axis. A hydraulic cylinder is connected to the frame and is also connected adjacent the upper edge of the scraper blade. Extension of the hydraulic cylinder pushes the lower edge of the blade forwardly to create a scooping action.

There is a substantial vertical clearance from the top edge of the scraper blade to the underside of the frame from which it is supported. This prevents the frame from hanging up on the edge of the ditch bank when the blade is lowered into the bottom of the ditch so as to prevent disturbance of the soil in the bank and thereby prevent further erosion into the ditch. This clearance between the blade and the frame also prevents the frame from becoming entangled in trash and Weeds within the ditch when the blade is lowered.

In operation, the device is attached to the three point hitch of a conventional farm tractor. The tractor is backed up to the drainage ditch, and the device is lowered until the scraper blade engages the bottom of the drainage ditch. The tractor then moves forward slowly, and simultaneously the hydraulic cylinder is extended so as to cause the lower edge of the scraper blade to move forward in a slow, scooping action. As the silt is scooped out of the bottom of the ditch, the hydraulic cylinder is retracted so as to cause the lower edge of the scraper blade to move slowly rearwardly, thereby permitting the accumulated silt to be smoothed out adjacent the top edge of the ditch.

The device is simple in construction and provides an economical means by which farmers can clean out the drainage ditches surrounding their farms. The wheels of the tractor are kept remote from the drainage ditch, and therefore the tractor does not become bogged down in mud or silt as is the case with present devices.

DETAILED DESCRIPTION OF THE PREFERRED EMBODIMENT

Figure 1:
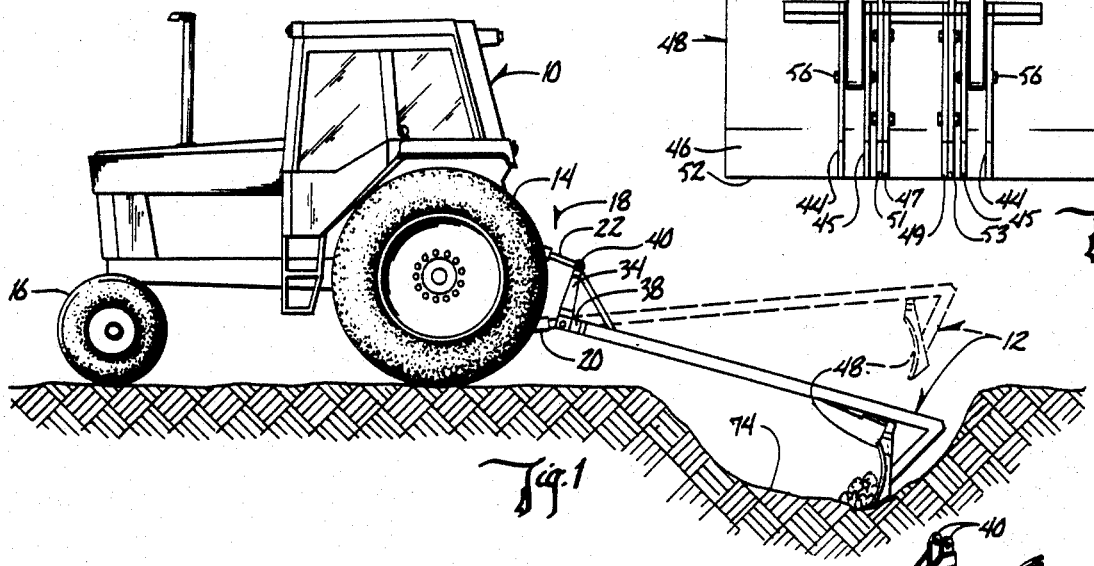
FIG. 1 is a side elevational view of a tractor having the present invention mounted thereon.
Figure 5:
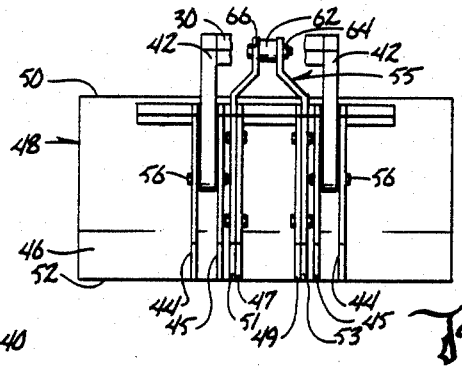
FIG. 5 is a sectional view taken along line 5—5 of FIG. 4.

Referring to the drawings, the numeral 10 generally refers to a conventional tractor having the soil scraper 12 mounted thereon. Tractor 10 includes ground engaging rear wheels 14 and front wheels 16. Tractor 10 also includes a three point hitch 18 comprising two lower lift arms 20 and an upper hitch link 22.

Figure 2:
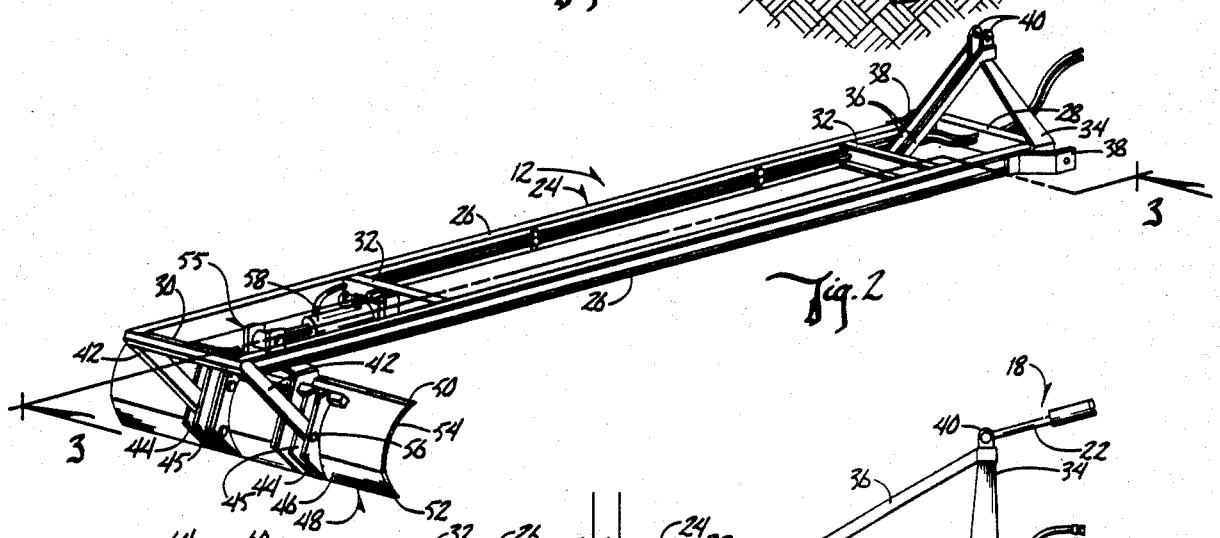
FIG. 2 is a perspective view of the present invention.

Referring to FIG. 2, scraper 12 includes a rectangular frame assembly 24 which includes two horizontal spaced apart side frame members 26, two opposite end frame members 28, 30, and two or more cross members 32 therebetween.

Mounted adjacent the forward end of frame assembly 24 are a pair of upstanding inclined arm members 34, which extend upwardly and toward one another. The upper ends of arm members 34 are connected to the upper end of an angular reinforcing member 36. Member 36 extends downwardly and rearwardly to a lower end which is welded or otherwise fixed to one of the cross members 32. Members 34, 36 form a three point hitch having a pair of spaced apart lower ears 38, for detachably receiving the lift arms 20 in conventional fashion. The juncture of the upper ends of arms 34 is provided with a pair of ears 40 for receiving the upper link 22 of the three point hitch 18.

Welded or otherwise secured to end frame member 30 are a pair of downwardly extending arms 42 which extend both downwardly and forwardly. The lower ends of arms 42 are pivotally secured to a spaced apart pair of mounting flanges 44, 45 which are welded or otherwise attached to the rear surface 46 of a scraping blade 48. Blade 48 includes an upper edge 50, a lower edge 52, and a forwardly presented concave arcuate surface 54. Flanges 44, 45 are mounted on the rear surface 46 of blade 48 and protrude rearwardly therefrom. They are pivotally mounted to the lower ends of arms 42 for pivotal movement about a horizontal axis 56.

Also welded to the back of blade 48 are an additional pair of spaced apart flanges 47, 49. Bolted to these flanges 47, 49 are the legs 51, 53 of a U-shaped frame 55 having a clevis 66 at the top thereof.

A hydraulic cylinder 58 includes a piston rod 60 which is extensible and which includes on its end a sleeve 62. Sleeve 62 is adapted to receive a mounting pin 64 which pivotally mounts sleeve 62 within clevis 66. Cylinder 58 also includes a rear sleeve 68 which is pivotally mounted to a clevis 70 on cross bar 32 by means of a pin 72. Cylinder 58 is in an approximately horizontal position when blade 48 is vertical so as to provide the maximum clearance above blade 48.

There is a substantial vertical clearance from the top edge of the scraper blade to the underside of the frame from which it is supported. This prevents the frame from hanging up on the edge of the ditch bank when the blade is lowered into the bottom of the ditch so as to prevent disturbance of the soil in the bank and thereby prevent further erosion into the ditch. This clearance between the blade and the frame also prevents the frame from becoming entangled in trash and weeds within the ditch when the blade is lowered.

Figure 3:
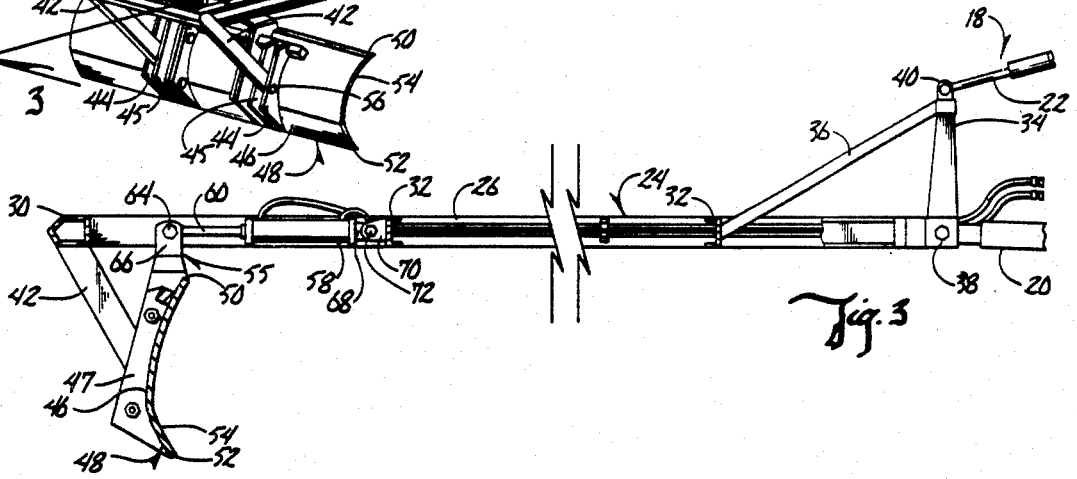
FIG. 3 is a sectional view taken along line 3—3 of FIG. 2.
Figure 4:
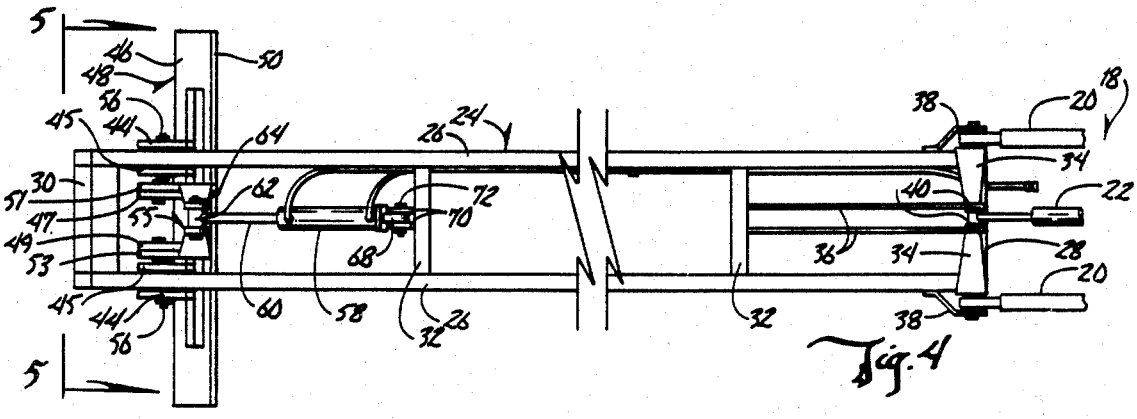
FIG. 4 is a top plan view of the present invention.

As seen in FIG. 3, extension of cylinder 58 causes blade 48 to be pivoted in a counterclockwise direction about the horizontal axis 56. This is because horizontal axis 56 is located below the pivotal axis provided by pin 64. Thus, extension of cylinder 58 causes the lower edge 52 of blade 48 to be moved forwardly in a scooping action. It is thus possible to push the lower edge 52 of blade 48 forwardly by extension of cylinder 58 without moving the tractor at all. Furthermore, it is possible to move the lower edge 52 of blade 48 rearwardly so that the blade can be used for a dragging or smoothing operation.

In the operation of the device, the tractor 10 is backed up to the edge of a drainage ditch 74. Often such drainage ditches include mud or boggy material at the bottom thereof, and therefore it is undesirable to drive the tractor into the ditch itself because the tractor might become mired or stuck in the mud.

With the present invention, it is possible to back the tractor up to the edge of the ditch as is shown in FIG. 1 and to lower the scraper 12 to the position shown in solid lines in FIG. 1. Extension of the cylinder 58 will cause the blade to be pivoted about axis 56 to the desired attitude for scraping. It is possible to engage the ground and continue extending cylinder 58 to cause the blade to dig into the bottom of the ditch, and this can be accomplished without moving the tractor at all.

After the blade has engaged the bottom of the ditch, the tractor can be moved forwardly and at the same time the attitude of the blade can be controlled by extending or retracting cylinder 58. As the blade rides up out of the ditch, it is possible to retract the hydraulic cylinder 58, thereby causing the lower edge 52 of the blade to extend rearwardly so as to create a dragging action. This will permit the smoothing of the soil which has been scraped from the bottom of the ditch.

The length of the frame 24 should be at least five feet, and it is possible to have the length considerably longer. This long frame permits the blade 48 to engage the bottom of the ditch while the tractor is located remotely from the ditch and well away from the mud at the bottom of the ditch.

The present invention is simple in construction and is far less expensive to manufacture and sell than presently used equipment for cleaning the bottoms of ditches. Most equipment presently used includes bulldozers or backhoes which are considerably more expensive than the scraping blade of the present invention.

Furthermore, the scraping blades currently available for farm tractors would not be usable for the process of the present invention. They do not extend sufficiently far rearwardy from the vehicle to permit the blade to engage the bottom of the ditch, while at the same time permitting the vehicle to keep its wheels out of the ditch and remote from the mud surrounding the ditch.

Another advantageous feature of the present invention is the ability to move the blade in a pushing action prior to the time that the tractor is moved forwardly. Extension of the hydraulic cylinder permit the lower edge of the blade to push forwardly against the mud and dirt in the bottom of the ditch. This creates a forwardly pushing and scooping action not readily obtainable with prior devices.

Thus, it can be seen that the device accomplishes at least all of its stated objectives.

What is claimed is:

1. A soil scraper and leveler for use with a tractor having a three point hitch comprising:

an elongated frame having a longitudinal axis and forward and rearward ends, three point connection means rigidly mounted on said forward end of said frame and including a pair of spaced apart lower attachment members and an upper attachment member for permitting detachable connection of said forward end of said frame to said three point hitch;

an elongated scraper blade pivotally mounted to said rearward end of said frame for pivotal movement about a horizontal axis extending transversely to said longitudinal axis of said frame;

extensible power means connected to said frame and to said scraper blade for causing said blade to pivot about said horizontal axis;

said frame having a length of at least five feet between said scraper blade and said three point connection means and extending in spaced relation above said scraper blade;

said power means being elongated and including a first end pivotally connected to said frame at a point located forwardly of said scraper blade and spaced rearwardly from said connection means, said power means having a second end pivotally connected to said scraper blade;

said blade being arcuate in cross section with a concave surface facing forwardly, a convex rearward surface facing rearwardly, an upper edge, and a lower edge, said horizontal pivotal axis of said scraper blade being located along a midportion of the blade below said pivotal connection of said power means to said blades whereby extension of said power means will cause said lower edge of said scraper blade to move forwardly toward said forward end of said frame, and retraction of said power means will cause said lower edge of said blade to move rearwardly;

said rearward end of said frame including a pair of downwardly extending frame arms, each of which includes a lower end, said blade being pivotally mounted to said lower ends of said frame arms to form said horizontal pivotal axis.

2. A soil scraper and leveler according to claim 1 wherein said frame arms extend both downwardly and forwardly.

3. A soil scraper and leveler according to claim 2 wherein said pivotal connection of said power means to said scraper blade is located adjacent said upper edge of said blade.

* * * * *